US005181704A

United States Patent [19]

Roblin

[11] Patent Number: 5,181,704

[45] Date of Patent: Jan. 26, 1993

[54] SAMPLE COLLATOR DEVICE WITH SAMPLES GATHERED ON PINS

[75] Inventor: William J. Roblin, North Royalton, Ohio

[73] Assignee: Dorn Color, Inc., Cleveland, Ohio

[21] Appl. No.: 734,556

[22] Filed: Jul. 23, 1991

[51] Int. Cl.[5] ..... B65H 39/02
[52] U.S. Cl. ..... 270/54; 270/58
[58] Field of Search ..... 270/54, 55, 57, 58, 270/52; 414/788.1, 789.6, 791.1

[56] References Cited

U.S. PATENT DOCUMENTS

| | | | |
|---|---|---|---|
| 3,525,516 | 8/1970 | Bushnell | 270/54 |
| 4,177,979 | 12/1979 | Orsinger | 270/54 |
| 4,198,039 | 4/1980 | Bryson | 270/54 |
| 4,463,941 | 8/1984 | Scholough | 270/54 |
| 4,801,036 | 1/1989 | Rathert | 270/54 |
| 5,031,891 | 7/1991 | Kobler | 270/54 |

FOREIGN PATENT DOCUMENTS

| | | | |
|---|---|---|---|
| 623756 | 9/1978 | U.S.S.R. | 270/54 |
| 2197298 | 5/1988 | United Kingdom | 270/54 |

*Primary Examiner*—Edward K. Look
*Assistant Examiner*—John Ryznic
*Attorney, Agent, or Firm*—D. Peter Hochberg; Mark Kusner; Louis J. Weisz

[57] ABSTRACT

A carousel device for collating product samples includes pivoting arms provided with suction cups attached to the ends thereof that swing in a first direction toward adjacent bins until the cups contact and attach to samples stored in the bins. The arms then pivot in the reverse direction to a position in which a hole in the sample is engaged by a pin attached to one of a plurality of trolleys propelled around the carousel and past the arms by a moving chain. The vacuum is released as the trolleys move onward to another set of arms where an additional sample is placed on the pin. The process continues as the trolleys make a complete circuit of the carousel and collect a collated set of each of the samples contained in the bins.

22 Claims, 4 Drawing Sheets

SAMPLE COLLATOR DEVICE WITH SAMPLES GATHERED ON PINS

This invention relates to the assembly of multiple product sample selectors. More particularly, this invention relates to a device which automatically collates product samples for the purpose of facilitating their binding into a selection assemblage. Specifically, this invention relates to a carousel device that includes multiple product sample bins located about its periphery from which individual product samples are sequentially, automatically removed and collated to form representative product sample selection decks.

BACKGROUND OF THE INVENTION

Many companies commonly sell products which although similar, or essentially identical, differ in appearance by virtue of their color, texture, or some other similar feature. In such cases, it is desirable that representative ones of the available product options be provided in the form of samples for inspection by prospective customers. Such products include, for example, paints, shingles, laminates, slatted blinds intended for window coverings, and a myriad of other goods too numerous to mention.

In many instances, as in the case of paints, for example, the colors are fastened as color squares or chips to pamphlets and brochures. Still other products are bound into product sheaves, for instance, carpet samples or wall coverings. Still other products are made available in the form of "decks" of samples, i.e., small, identical, representative portions of the product, differing only in their representation of the product variations available for purchase. These are strung in loops on beaded chains, or fastened together by means of rigid posts. Such decks are compact and facilitate side-by-side comparison of the available product options by purchasers. An additional advantage is that the product sample decks permit dealers to offer visual product inspection without the necessity of their carrying large and expensive inventories of the goods being offered for sale.

Product sample decks of the type described are relatively inexpensive on an individual basis; however, manufacturers must distribute the decks widely to maximize sales opportunities. They are also required to replace the decks relatively frequently, for example, due to loss, for reasons of style obsolescence, or as colors change; consequently, the overall sampling of the decks can involve considerable expense, notwithstanding their modest individual cost.

An additional problem with the product decks is that they must be manually assembled. Not only does this require considerable labor to accomplish, but it is not uncommon for incomplete decks to be assembled as the result of human error, made even more probable as a consequence of the tedium of the assembly task. With respect to defective product decks, when samples fail to be included in the decks due to errors of the type mentioned, prospective purchasers are frequently unaware of a purchase option represented by the missing sample exists. Therefore, the oversight can mean important lost sales opportunities for the manufacturer.

Furthermore, the need to prepare product sample decks is not a responsibility welcomed by most manufacturers of the products represented thereby since the deck assembly operation is a business cost, rather than a profit center, and is merely ancillary to a manufacturer's primary interest in making and selling the product represented by the samples.

BRIEF DESCRIPTION OF THE INVENTION

In view of the foregoing, therefore, it is a first aspect of this invention to provide a new and improved system for preparing product sample decks.

A second aspect of this invention is to eliminate the need to manually collate the components which are to be included in product sample decks.

It is an additional aspect of this invention to provide product sample decks without any samples missing therefrom.

A further aspect of this invention is to assemble product sample decks much more rapidly than is possible when they are prepared manually.

Another aspect of this invention is to provide a way in which to assemble product sample decks less expensively than is presently possible.

A still additional aspect of this invention is to provide a way in which to assemble decks of sample slats for slatted blinds used in window coverings.

Yet a further aspect of this invention is to provide a device for collating and assembling product sample decks automatically.

The foregoing and still other aspects of the invention are provided by a collator device for samples comprising a revolving carousel that includes: sample storage means; sample selection means; sample transport means; and motor means. The samples are removed from the storage means by the sample selection means and gathered in collated sequence by the transport means which is moved around the carousel by the motor means.

The foregoing and additional aspects of the invention are provided by a trolley device adapted to move along track to which it is connected. The track comprises two spaced-apart rails, and the trolley includes an articulated frame on which is mounted spaced-grip means to hold the trolley device to the rails. The grip means for one rail is urged toward the grip means for the other rail by the force of spring means, such force holding the grip means securely to the rails.

The foregoing and further aspects of the invention are provided by a collator device for samples comprising a revolving carousel that includes sample storage means comprising a plurality of bins each of which contains samples therein. Also included are sample selection means comprising suction cups mounted on the ends of arms rotatably mounted adjacent to the bins from which samples are to be removed. The selection means pivots from a first location in which a vacuum applied to the cups permits them to withdraw samples from the bins, to a second location in which the vacuum is released and the samples are disengaged from the cups. The device also includes sample transport means comprising a trolley mounted on, and guided about the carousel by a track, the trolley being connected to a power transmission chain which moves the trolley along the track. Means are provided on the trolley for holding the collated samples placed thereon, and timing means for coordinating the application and release of the vacuum to the disks, and the movement of the arms relative to the position of the trolley are also provided. Motor means operate the chain and the timing means of the device.

DESCRIPTION OF THE DRAWINGS

The invention will be better understood when reference is had to the following drawings in which like-numbers represent like-parts, and in which.

DETAILED DESCRIPTION OF THE INVENTION

Figure 1:
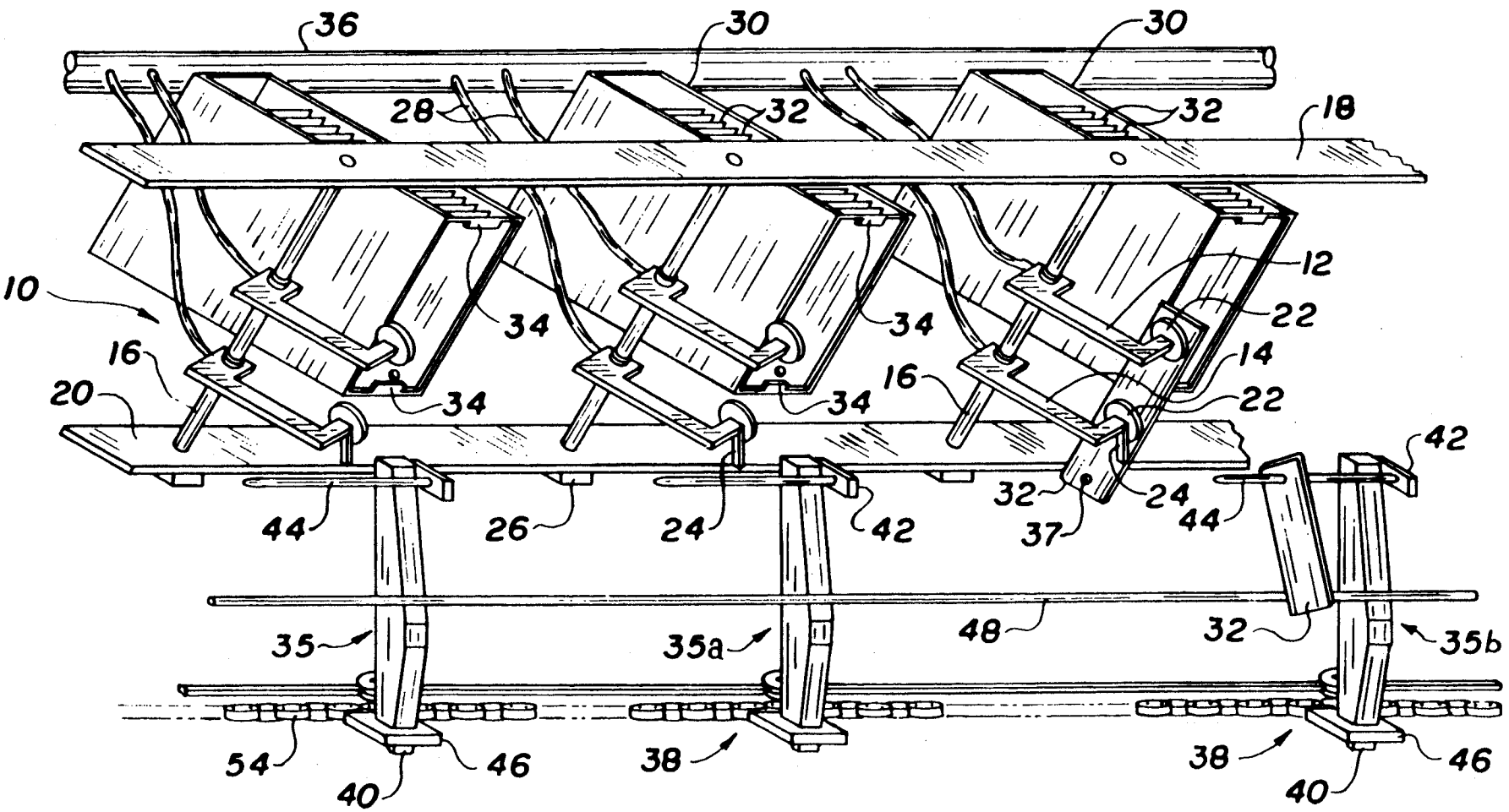
FIG. 1 is a partial isometric view of the product sample collator device of the invention.

FIG. 1 is a partial isometric view of the samle collator device of the invention. As shown, the device includes sample selection means, generally 10, comprising an upper pivot arm 12 and a lower pivot arm 14 mounted on a pivot arm axial shaft 16 held between an upper axial shaft journal plate 18, and a lower axial shaft journal plate 20. Each of the pivot arms 12 and 14 is attached to a vacuum line 28. Controlling the sample selection means 10 is a vacuum interrupter and pivot mechanism enclosed in a housing 26. A flexible wiper pad 24, whose purpose will be explained hereinafter, is advantageously located adjacent the suction cup on the lower pivot arm 14.

Sample selection means 10 are provided for each of the samples to be collated to form a product deck, each being located adjacent a sample storage bin 30. As a vacuum is applied to the pivot arms 12 and 14 they swing inwardly toward bin 30 where they withdraw samples past sample stops 34 and swing to their fully extended position in which the sample is available for pick-up by the pin trolley 38. The sample storage bin has a number of samples 32 located therein, being held in position by sample stops 34 which are appropriately adjustable in a vertical direction. The sample stops serve the purpose of preventing the samples 32 from falling out of the bin, which are located at an angle from the horizontal, unless withdrawn by the sample selection means 10.

Positioned adjacent each of the assembly stations, generally 35. which comprise sample selection means 10 and an associated sample storage bin 30, are sample transport means which comprises a pin trolley, generally 38, that is removably located in a hole in a post-anchoring plate 46, the latter being connected to a drive chain 54. The pin trolley 38 has a sample collating pin 44 extending horizontally therefrom in the direction of travel of the pin trolley.

Product sample collation is accomplished as the pin trolley 38 is moved steadily along the track to which it is connected by drive chain 54. As it approaches an assembly station 35, for example, pivot arms 12 and 14 are pivoted toward bin 30 and a vacuum is applied from vacuum manifold 36 through vacuum lines 28 to suction cups 22. Pivoting of the arms and application of the vacuum is controlled by a vacuum interruption and pivot mechanism, shown schematically as housing 26. Details with respect to application and interruption of the vacuum, and to the pivoting of the arms are not shown since methods for accomplishing such pivoting and periodic application and interruption of a vacuum are well-known by those skilled in the art.

As the suction cups come into contact with the sample 32 exposed at the end of the bin, the sample is firmly grasped by the arms as the result of its contact with the cups, and as the arms pivot outwardly away from the bin, the relatively flexible sample, is drawn past the sample stops 34. Assembly station **35*a* shows a sample 32 being held in position for pick-up by an approaching trolley 38. As the trolley reaches the sample 32, the pin 44 engages sample hole 37, as shown at assembly station 35*b*. Following such engagement, the vacuum operating on suction cups 22 is interrupted, allowing the sample 32 to become detached, after which it swings downwardly on pin 44 until it comes to rest on stabilizer bar 48**. The purpose of the stabilizer bar is to prevent the sample from swinging back and forth, a motion which could bring it into interfering contact with other structure of the device.

While the number of assembly stations will advantageously equal the number of samples to be collated, the collating device can be operated, for example, to collate only a part of a product sample deck, after which the bins can be loaded with a different set of product samples and the device re-run to assemble a second part of the deck. Thereafter, the two product deck parts can be combined to form a complete single deck. The construction of carousel collator devices of the invention having as many as 64 or more stations is readily accomplished, and the capacity of the bins 30 can also be adjusted so that the collating device can be used to assemble whatever number of product decks is required for a particular run.

The cycle time of the stations is variable and will be adjusted to correspond to the speed and number of the trolleys employed. Normally, the distance between trolleys will equal the distance between the sample bins. Cycle times of as little as 3 seconds are practical, allowing completed product decks to be removed from the device at intervals equal to that period of time.

Figure 2:
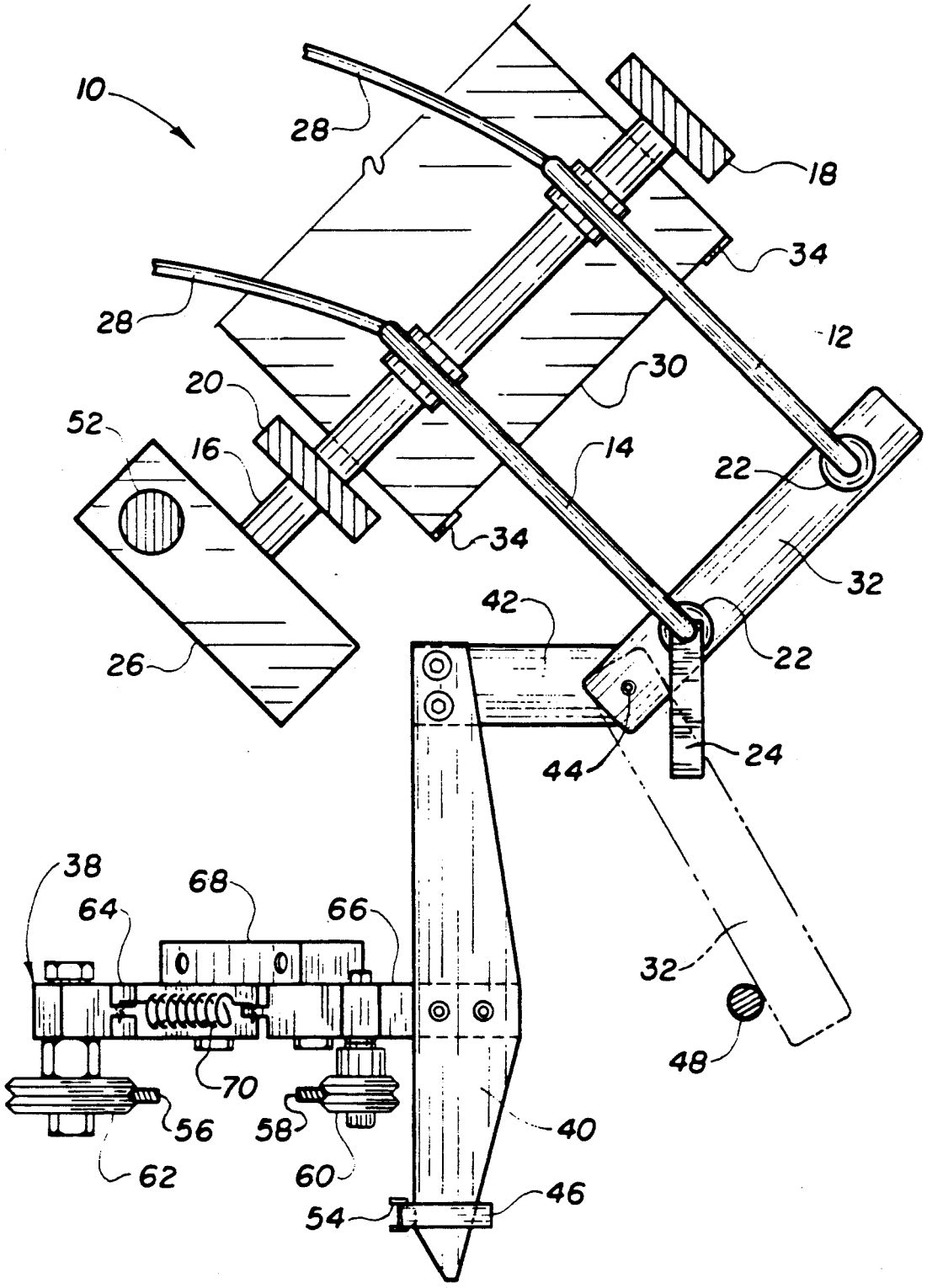
FIG. 2 is a cross-sectional view of the product sample collator device of the invention along line 2—2 of FIG. 4.
Figure 4:
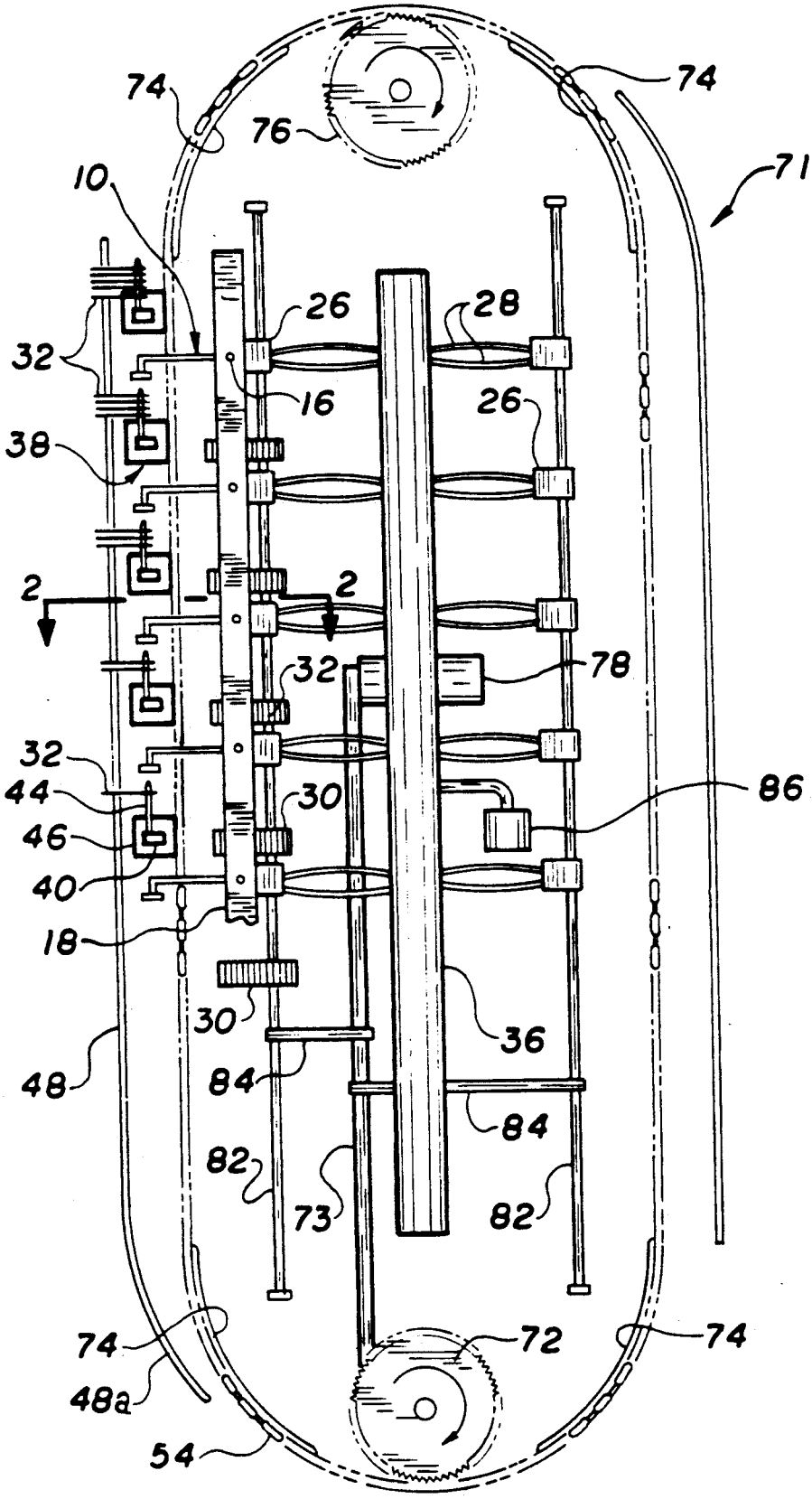
FIG. 4 is a semi-schematic plan view of the collator device of the invention.

FIG. 2 is a cross-sectional view of the sample collator device of the invention along line 2—2 of FIG. 4. As illustrated, the sample selection means is shown in its extended position, a position allowing pick-up of a product sample by the trolley. In such position, upper and lower pivot arms, 12 and 14 respectively, have been swung outwardly with suction cups 22 securely fastened to product sample 32. Pivot arms 12 and 14 are held on rotating arm axial shaft 16, secured between upper and lower axial shaft journal plates 18 and 20, respectively. Vacuum lines 28 are connected to the arms, allowing a vacuum to be made available to the suction cups 22, as required. The housing 26 for the vacuum interruption and pivot mechanisms is shown connected to a shaft 52 which furnishes power to the housing and its included parts. The shaft accomplishes periodic interruption of the vacuum and the timing of pivoting of the pivot arms by means of its attachment to cams and lever mechanisms well known to the art.

The pin trolley 38 is shown as comprising a trolley connection post 40 connected to a pin support arm 42, with holding pin 44 being fastened thereto. Also connected to trolley connection post 40 is a roller support arm 66, which is fastened to another roller support arm 64 by a roller support arm link 68. The connection between the support arms and the link is articulated, allowing stacked disk rollers 60 and 62 to be urged toward each other by the force exerted by spring 70. Such force allows the stacked disk rollers to firmly engage trolley inner and outer track rails 56 and 58, respectively.

As vacuum to suction cups 22 is interrupted, the product sample 32 swings downwardly to the position shown in phantom, where it rests against stabilizer bar 48. The sample is thereafter moved backwardly on the pin by the action of wiper pad 24 as the trolley is advanced as a consequence of the movement of post-anchoring plate 46, attached to moving drive chain 54.

Dimensions of the collating device, and its associated parts will vary, depending upon the sample size, the number of stations, and like considerations. Typically, the inner and outer track rails 56 and 58, respectively, will be spaced-apart at a distance of about 1¾ to 2¼ inch. The length of the pin 44 will depend upon the number of samples to be held thereon during any revolution of the carousel; however, a pin length of from about 2½ to 4 inches in length is common.

The vacuum employed to hold the samples 32 to the suction cups 22 will be determined by the type of sample to be held, particularly its weight; however, a vacuum equivalent to about 20 inches of mercury is adequate in most instances.

Figure 3:
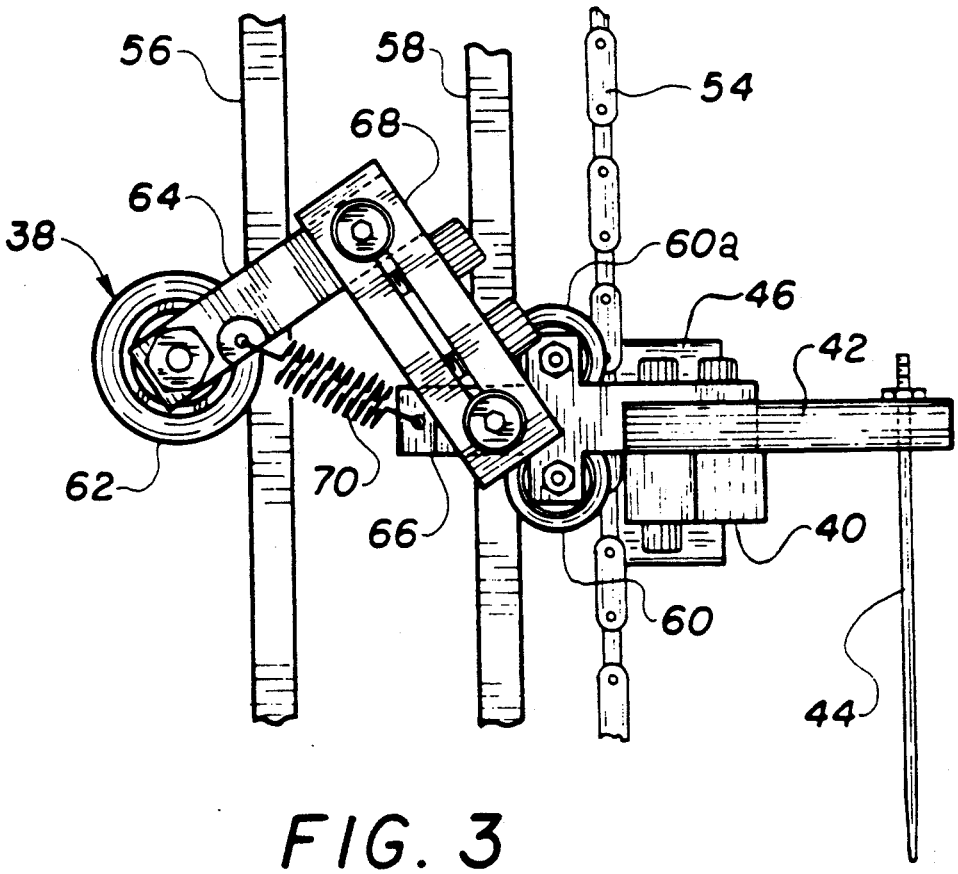
FIG. 3 is a plan view of the trolley device of the invention held on a carousel track and connected to a power transmission chain.

FIG. 3 is a plan view of the trolley device of the invention held on a carousel track and connected to a power transmission chain. The figure shows the trolley connection post 40 which is held in a counterpart hole located in post-anchoring plate 46, the latter being connected to drive chain 54. The trolley connection post 40 holds a pin support arm 42 to which a sample holding pin 44 is fastened. The trolley connection post 40 is also connected to a roller support arm 66 having two sets of V-groove rollers 60 and 60*a*, respectively, attached thereto. Roller support arm 66 is fastened by an articulated connection to roller support arm link 68, which in turn is fastened by a similar articulated connection to roller support arm 64, the latter arm having a stacked disk roller 62 connected thereto. Stacked disk rollers 60 and 60*a* are urged toward stacked disk roller 62 by means of spring 70. The disk rollers enclose inner and outer track rails 56 and 58, respectively, being held thereto by the force of the spring 70.

The articulated linkages shown allow the pin trolleys to be positioned or removed onto, or from the track rails at will. A further advantage is that they allow the pin trolley 38 to disengage itself from the track in the event a jam of the device occurs for any reason, thereby avoiding damage to the trolley and to the device.

Any of a variety of power transmission systems can be used to transport the trolleys around the carousel, including cables, chains, and the like; however, roller-type power transmission chains have been found to be particularly adapted to purposes of the invention, and their use is, therefore, preferred.

Although the collating device illustrated in the figures is shown in connection with a sample holding pin 44, other sample holding means can also be employed, for example, bins of various shapes mounted on the trolley.

FIG. 4 is a semi-schematic plan view of the collator device, generally 71, of the invention. The device shows a representative number of assembly stations including sample selection means 10, and the associated sample storage bins 30. Also shown are the post-anchoring plate 46, and holding trolley connection post 40 of pin trolley 38 with its attached pin 44. The figure illustrates how sample 32 removed from sample storage bin 30 are received on the pins 44 and rest on stabilizer bar 48. The housing 26 for the vacuum and pivot arm controls is also shown adjacent to upper axial shaft journal plate 18 which journals pivot arm axial shaft 16.

The geometric shape of the carousel is also apparent, taking the form of two parallel lines connected at their respective ends by semicircles, although other shapes are also useful. The drive chain 54 is driven by drive sprocket 72, revolving about idler sprocket 76, and the shape of the carousel is maintained by chain guides 74. The direction of movement of the chain is shown by the associated sprocket arrows.

Also to be seen is drive motor 78 which drives the sprocket 72 by means of a transmission shaft 73. The transmission shaft 73 additionally drives assembly station drive shafts 82 by means of power belting 84.

A vacuum is produced in vacuum manifold 36 by means of a vacuum pump 86 attached thereto, the manifold itself being connected to housing 26 by vacuum lines 28.

After being released from the sample selection means the product samples 32 swing downwardly, as previously described, to rest upon stabilizer bars 48. The stabilizer bars are bent inwardly and downwardly at one end thereof so that samples approaching the stabilizer bars from the location of the sprockets, the product samples at that point hanging vertically downwardly from the pins 44, can be picked up by, and again supported on the stabilizer bars.

The sample collator carousel 71 can be driven at whatever speed is desired, a speed of about 10 feet per minute being typical.

The geometric dimensions of the carousel may vary; however, a carousel having a width of from about 20 to 24 inches wide and being about 15–20 feet long is adequate for assembling most product sample decks.

Removal of collated product samples from the carousel can either be accomplished by removing the samples from the pins manually, or suitable disengaging machinery can be provided.

Figure 5:
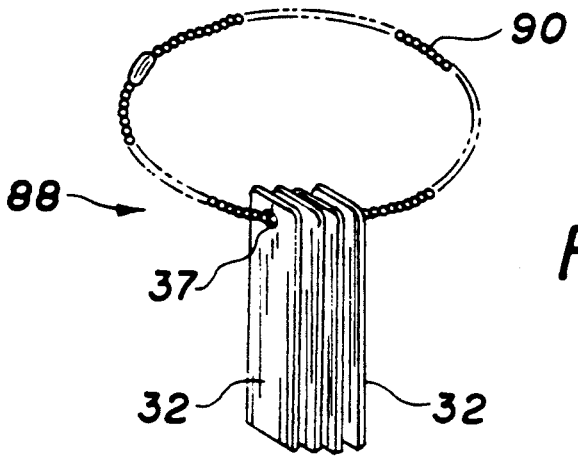
FIG. 5 is a deck of window slat samples assembled on a ball chain.

FIG. 5 shows a deck of window slat samples assembled on a ball chain. The deck is typical of samples that may be collated by the carousel device of the invention. As shown, the product samples 32 are strung on a ball chain 90 extending through holes 37 to form a product sample deck 88.

While other sized samples may be used, in the case of window slat samples, those having a length of about 6 inches long, and being about 1 inch in width, concavely shaped or flat along their transverse axis and having a hole located at one end, are particularly suited to being collated by the carousel device of the invention.

While in accordance with the patent statues, a preferred embodiment and best mode has been presented, the scope of the invention is not limited thereto, but rather is measured by the scope of the attached claims.

What is claimed is:

1. A collator device for samples comprising a revolving carousel that includes:

storage means for hole-containing samples;

sample selection means;

pin-containing sample transport means; and motor means, wherein hole-containing samples are removed from said storage means by said sample selection means and gathered in collated sequence on pins attached to said transport means which is moved around said carousel by said motor means.

2. A collator device for samples comprising a revolving carousel that includes:

sample storage means;

sample selection means;

sample transport means; and motor means, wherein hole-containing samples are removed from said storage means by said sample selection means and gathered in collated sequence on pins attached to said transport means which is moved around said carousel by said motor means, and wherein further, said storage means comprises a plurality of sample storage bins; said sample selection means includes suction means for gripping and removing samples from said bins, and wherein still further, said transport means includes revolving means which moves said pins between bins in sequence about said carousel, said movement being coordinated with sample selection means by timing means so that samples are removed from said bins and released by said suction means after said pins have entered the holes in said samples.

3. A device according to claim 2 in which said sample selection means comprises suction cups mounted on the ends of arms rotatably mounted adjacent to said bins from which the cups remove samples, said arms pivoting from a first location at which a vacuum applied to said cups permits them to withdraw samples from the bins, to a second location at which the vacuum is released, allowing the samples to be held by said pins.

4. A device according to claim 3 wherein said transport means comprises trolleys mounted on, and guided about said carousel by a track, said trolleys being connected to a power transmission chain which moves said trolleys on said track, said trolleys including said pins for holding collated samples thereon.

5. A device according to claim 4 in which said track comprises two spaced-apart rails, and said trolley includes an articulated frame on which are mounted spaced-apart grip means adapted to engage said rails, grip means for one rail being urged toward grip means for the other rail by the force of spring means, said force holding said trolley securely to said rails.

6. A device according to claim 5 in which said grip means comprises rotatable, V-groove wheels, said rails being positioned between the edges of said wheels.

7. A collator device for samples comprising a revolving carousel that includes:

sample storage means;

sample selection means;

sample transport means; and motor means wherein samples are removed from said storage means by said sample selection means and gathered in collated sequence by said transport means which is moved around said carousel by said motor means;

wherein said storage means comprises a plurality of sample storage bins; said sample selection means includes suction means for gripping and removing samples from said bins, and said transport means comprises sample holding means attached to revolving means which moves said holding means between said bins in sequence about said carousel, said movement being coordinated with said sample selection means by timing means so that samples are removed from said bins and released by said suction means into said holding means;

wherein said sample selection means comprises suction cups mounted on the ends of arms rotatably mounted adjacent to said bins from which the cups remove samples, said arms pivoting from a first location at which a vacuum applied to said cups permits them to withdraw samples from the bins to a second location at which the vacuum is released, allowing the samples to be received by said holding means;

wherein said transport means comprises trolleys mounted on, and guided about said carousel by a track, said trolleys being connected to a power transmission chain which moves said trolleys on said track, said trolleys including means for holding collated sample thereon, and wherein said holding means comprises a cantilevered pin extending from said trolleys, and said samples include a hole therein adapted to receive said pin.

8. A device according to claim 7 which includes support members adjacent to said transport means on which samples positioned on said pins rest.

9. A device according to claim 8 in which two arms are provided, together with a wiper tab adapted to contact samples positioned on said pins and to force them toward the pins fixed end.

10. A device adapted to move along a track to which it is connected, said track comprising two spaced-apart rails, wherein said device includes an articulated frame on which are mounted spaced-apart grip means adapted to engage said rails, grip means for one rail being urged toward grip means for the other rail by the force of spring means, said force holding said grip means securely to said rails.

11. A device according to claim 10 in which said grip means comprises rotatable, V-groove wheels, said rails being positioned between the edges of said wheels.

12. A collator device for samples comprising a revolving carousel that includes:

sample storage means comprising a plurality of sample storage bins;

sample selection means comprising suction cups mounted on the ends of arms rotatably mounted adjacent to said bins from which they remove samples, said selection means pivoting from a first location at which a vacuum applied to said cups permits them to withdraw samples from the bins, to a second location in which the vacuum is released and the samples are disengaged from said cups;

sample transport means comprising trolleys mounted on, and guided about said carousel by a track, said trolleys being connected to a power transmission chain which moves said trolleys on said track, said trolleys including means for holding collated samples thereon;

timing means for coordinating the application and release of said vacuum to said cups, and the movement of said arms, relative to the position of said trolleys, and motor means for operating said chain and said timing means, and wherein said track comprises two spaced-apart rails, and said trolleys include an articulated frame on which is mounted spaced-apart grip means for said rails, grip means for said one rail being urged toward grip means for the other rail by the force of spring means, said force holding said trolleys securely to said rail.

13. A device according to claim 12 in which said pins are cantilevered from said trolleys, and said samples include a hole adjacent to an end thereof adapted to receive said pins.

14. A device according to claim 13 in which said carousel is configured in the geometrical shape of two parallel lines joined at their ends by semicircular lines, said bins and sample selection means being spaced along said parallel lines.

15. A device according to claim 14 in which said device also includes support members positioned parallel to said parallel lines on which samples positioned on said pins rest.

16. A device according to claim 15 in which said samples are elongated slat members.

17. A collator device for hole-containing samples comprising a revolving carousel that includes a plurality of sample storage bins;

sample selection means comprising suction cups mounted on the ends of the arms rotatably mounted adjacent to said bins from which they remove samples, said selection means pivoting from a first location at which a vacuum applied to said cups permits them to withdrawn samples from the bins, to a second location in which the vacuum is released and the samples are disengaged from said cups;

sample transport means comprising trolleys mounted on, and guided about said carousel by a track, said trolleys being connected to a power transmission chain which moves said trolleys on said track, said trolleys having pins attached thereto for holding collated samples thereon;

timing means for coordinating the application and release of said vacuum to said cups, and the movement of said arms, relative to the position of said trolleys, and motor means for operating said chain and said timing means.

18. A device according to claim 17 in which said track comprises two spaced-apart rails, and said trolleys include an articulated frame on which is mounted spaced-apart grip means for said rails, grip means for said one rail being urged toward grip means for the other rail by the force of spring means, said force holding said trolleys securely to said rail.

19. A device according to claim 18 in which said pins are cantilevered from said trolleys, and said samples include a hole adjacent to an end thereof adapted to receive said pins.

20. A device according to claim 19 in which said carousel is configured in the geometrical shape of two parallel lines joined at their ends by semicircular lines, said bins and sample selection means being spaced along said parallel lines.

21. A device according to claim 20 in which said device also includes support members positioned parallel to said parallel lines on which samples positioned on said pins rest.

22. A device according to claim 21 in which said samples are elongated slat members.

* * * * *